United States Patent [19]

Horsfall

[11] 4,169,786

[45] Oct. 2, 1979

[54] DENSE MEDIUM SEPARATION

[76] Inventor: David W. Horsfall, 114, Killarney Park, 5th St., Killarney, Johannesburg, Transvaal, South Africa

[21] Appl. No.: 852,528

[22] Filed: Nov. 17, 1977

[30] Foreign Application Priority Data

Nov. 17, 1976 [ZA] South Africa ..... 76/6878

[51] Int. Cl.[2] ..... B03B 7/00

[52] U.S. Cl. ..... 209/12; 209/39; 209/172.5

[58] Field of Search ..... 209/172.5, 39, 12, 13, 209/17

[56] References Cited

U.S. PATENT DOCUMENTS

| | | | |
|---|---|---|---|
| 2,373,635 | 4/1945 | Wuensch | 209/172.5 X |
| 2,569,141 | 9/1951 | Bakels | 209/12 |
| 2,744,627 | 5/1956 | Enck | 209/172.5 |
| 3,031,074 | 4/1962 | Osawa | 209/172.5 X |

FOREIGN PATENT DOCUMENTS

| | | | |
|---|---|---|---|
| 172405 | 2/1952 | Austria | 209/172.5 |
| 1022959 | 12/1952 | France | 209/172.5 |
| 1232122 | 4/1960 | France | 209/172.5 |
| 78348 | 5/1955 | Netherlands | 209/172.5 |

*Primary Examiner*—Robert Halper
*Attorney, Agent, or Firm*—Young & Thompson

[57] ABSTRACT

In a dense medium separation process a product of a separation step containing separated material and magnetic dense medium particles is passed through a sieve bend and the undersize only is treated for the magnetic recovery of the dense medium particles.

1 Claim, 1 Drawing Figure

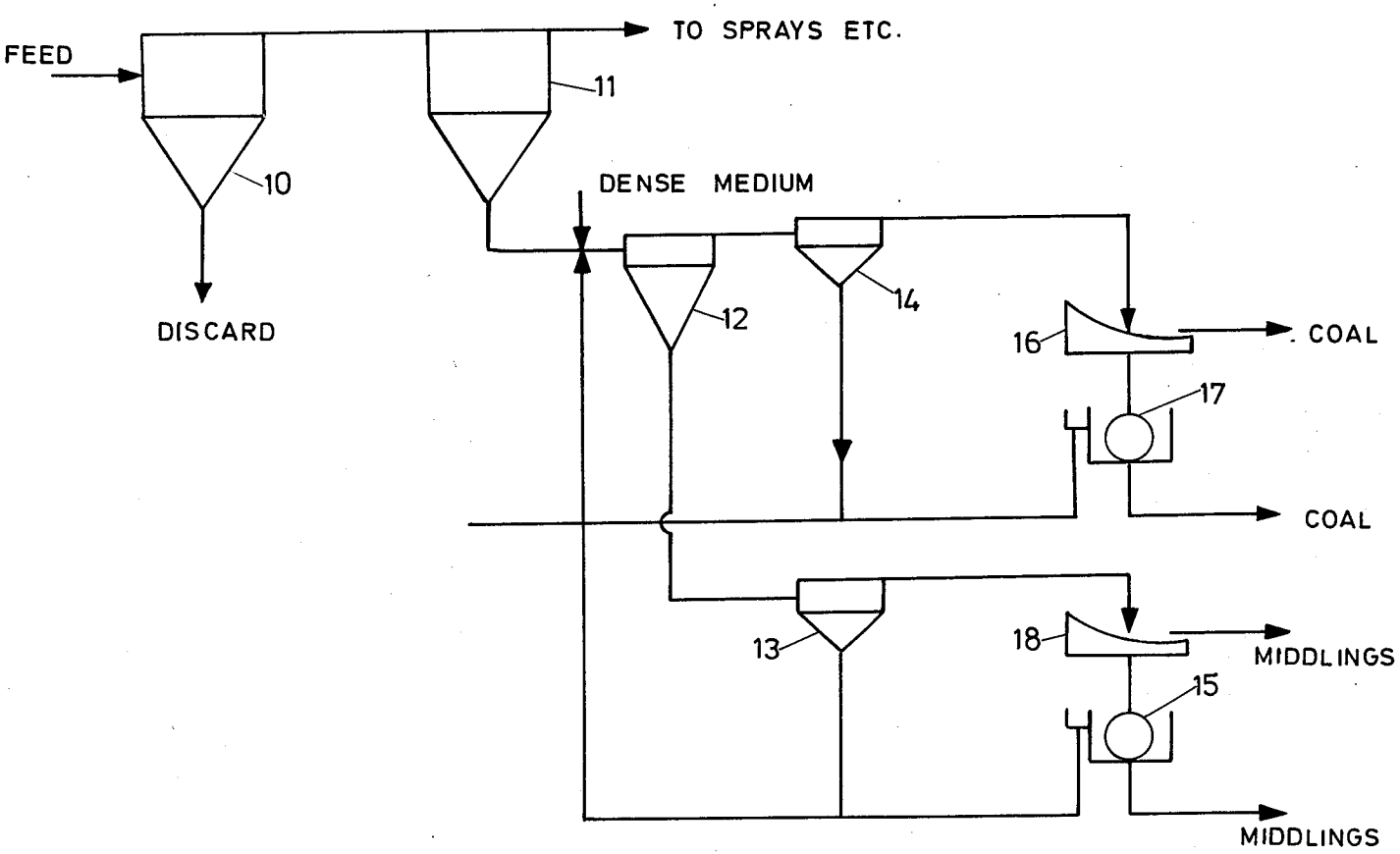
FEED
10
DISCARD
TO SPRAYS ETC.
11
DENSE MEDIUM
12
14
16
17
COAL
COAL
13
18
15
MIDDLINGS
MIDDLINGS

DENSE MEDIUM SEPARATION

BACKGROUND TO THE INVENTION

This invention relates to dense medium separation processes of the kind in which material to be beneficiated is passed with a dense medium suspension to a gravity separation step, e.g. in a cyclone, to give two fractions. One fraction is a suspension containing light particles from the material and some of the dense medium particles, while the other fraction is a suspension containing dense particles from the material and some medium particles.

The present invention is particularly concerned with methods of treating these two product fractions to separate medium particles from the constituent originating from the original material. The invention is also concerned with the overall treatment process.

The applicant has already proposed that each of the abovementioned two fractions be subjected to at least a single stage high relative density separation to form a secondary first fraction containing substantially only dense medium particles and a secondary second fraction containing the bulk of the other particles. The secondary second fraction may then be subjected to a recovery process, such as magnetic recovery, for the recovery of the remaining dense medium particles.

SUMMARY OF THE INVENTION

According to the present invention the secondary second fraction is passed through a screening step, e.g. through a sieve bend, to screen out coarse particles from the original feed, and the undersize is subjected to a recovery process, such as magnetic recovery, for the recovery of the remaining dense medium particles.

The invention is predicated by the fact that in the formation of the secondary fractions not only density separation is effected but there is also a classification process tending to cause dense medium particles of an average particle size less than those in the secondary first fraction to pass into the secondary second fraction. In addition much of the water in the feed passes into the secondary second fraction and thus there is a saving on the amount of water required for spraying purposes in the screening step. In the result the load on the magnetic separator is considerably reduced so that a smaller separator may be used for a given throughput.

DESCRIPTION OF THE DRAWING

A flow sheet of a coal beneficiating process is illustrated.

DESCRIPTION OF A PREFERRED EMBODIMENT

The invention is further discussed with reference to the accompanying flow sheet of a coal beneficiating process.

In the drawing a raw coal feed which is sized, say, to plus 1000μ is first passed through a cleaning cyclone 10 with water only. The underflow from this cyclone is the discard and the overflow is thickened in a thickening cyclone 11. The overflow from this cyclone 11 is used as spray water and so on. The underflow is subjected to a dense medium separation process.

In this process the coal mixed with a dense medium suspension of, e.g. magnetite, is fed firstly to a conventional dense medium cyclone 12 to give an overflow as a primary first fraction and an underflow as a primary second fraction. Each of these fractions is fed to a cyclone 13 or 14, as the case may be.

The underflow from the cyclone 13 and 14 rejoins the dense medium circuit. The overflow from the cyclone 13 is passed to a magnetic separator 15 to provide clean middlings and overdense medium for return to the dense medium circuit.

The overflow from the cyclones 13 and 14 contain, in addition to a portion of the magnetic dense medium particles, the separated fractions of the raw coal feed. In conventional practice they would be separated by passing the overflows to magnetic separators. According to the present invention the burden on the magnetic separators are reduced by taking advantage of a property discovered in the products of the cyclones 13 and 14.

The dense medium particles used are nominally minus 75μ. However, in a test it was found that this resulted in a mean particle size of 21.9μ. In the underflow of the cyclone 14 the mean particle size increased to 32.1μ while in the overflow it became 11.5μ.

Consequently the difference in the particle size between the clean coal and the discard on the one hand and the magnetite on the other hand is accentuated. In the result a screening step would remove much of the coal or discard which would otherwise load the magnetic separators.

The overflow from the cyclone 14 or the secondary second fraction is now passed to a sieve bend 16 where reasonably easy separation of the 100μ and over coal from the dense medium particles is effected. The amount of spray used is minimal due to this and the dilution of the feed to the sieve bend as a result of the density separation of the medium particles occurring in the cyclone 14. The coarse product from the sieve bend 16 is high quality coal.

The fine product is passed to a magnetic separator 17 via a sieve bend 18 also to produce good coal and a return feed of dense medium particles.

The process thus produces a discard which goes to waste, good quality coal which may be used to make form coke and middlings which may be used for steam raising.

I claim:

1. A process in which fine coal is passed with a magnetic dense medium suspension to a first densimetric hydrocyclone to yield an overflow containing less dense coal particles and some of the dense medium particles and an underflow containing dense coal particles and some dense medium particles, the overflow and the underflow is passed through second and third densimetric hydrocyclones respectively, each of the second and third hydrocyclones yielding a secondary underflow containing substantially only dense medium particles and a secondary overflow containing the bulk of the coal particles, the secondary overflow in each case is passed through a screening step to screen out coal particles coarser than the dense medium particles, and the undersize from each screening step is subjected to magnetic separation for the recovery of the remaining dense medium particles, the thus recovered dense medium particles and the secondary underflows being recycled to make up the magnetic dense medium suspension.

* * * * *